United States Patent [19]

Szeremeta

[11] Patent Number: 4,781,785

[45] Date of Patent: Nov. 1, 1988

[54] APPARATUS FOR APPLYING FLEXIBLE PLASTIC LABELS TO ROUND CONTAINERS

[75] Inventor: Walter Szeremeta, Bardstown, Ky.

[73] Assignee: Owens-Illinois Plastic Products Inc., Toledo, Ohio

[21] Appl. No.: 119,942

[22] Filed: Nov. 13, 1987

[51] Int. Cl.[4] ..... B65C 9/04; B65C 9/22

[52] U.S. Cl. ..... 156/448; 118/231; 118/259; 118/261; 156/449; 156/568; 156/578; 156/DIG. 26; 156/DIG. 35

[58] Field of Search ..... 156/578, 568, 448, 449, 156/DIG. 35, DIG. 26; 118/231, 244, 259, 261; 403/92, 93, 326, 329

[56] References Cited

U.S. PATENT DOCUMENTS

| | | | |
|---|---|---|---|
| 3,800,743 | 4/1974 | Egnaczak | 118/259 |
| 4,323,416 | 4/1982 | Malthouse et al. | 156/521 |
| 4,574,020 | 3/1986 | Fosnaught | 156/215 |
| 4,693,210 | 9/1987 | DiFrank | 118/259 |
| 4,724,037 | 2/1988 | Olsen | 156/578 |

*Primary Examiner*—Michael Wityshyn

[57] ABSTRACT

In the application of a solvent to a plastic label carried on the surface of a vacuum drum, the solvent for the plastic label is transferred from a gravure roll to the label at finite areas on the label so that the label can adhere to the bottle to be labeled and to itself to form a complete sleeve label. The gravure roll is supplied from a fountain block with a part cylindrical face that engages the gravure roll in face to face contact. The fountain block is retained in a holder with spaced adjustment devices for adjusting the position of the fountain block in the holder.

The fountain block holder is pivotally attached to each of a pair of spaced apart plates about a first axis and the pair of spaced apart plates are pivotally attached to a second pair of spaced apart plates about a second axis which is spaced from and extends parallel to the first axis. The pivoting of the first pair of spaced apart plates with respect to the second pair of spaced apart plates is controlled by a releasable latch mechanism which maintains the fountain flock in engagement with the gravure roll and which permits the pair of spaced apart plates with the fountain block holder to be pivoted away from the gravure for servicing or changing the fountain block upon the releasing of the latch mechanism.

8 Claims, 3 Drawing Sheets

APPARATUS FOR APPLYING FLEXIBLE PLASTIC LABELS TO ROUND CONTAINERS

BACKGROUND OF THE INVENTION

1. Field of the Invention

This invention relates to equipment for applying double-ended flexible plastic labels to round containers, such as bottles and cans, on a high-speed production basis.

2. Description of the Prior Art

U.S. Pat. No. 4,323,416 (Malthouse et al.) discloses equipment for applying double-ended labels from a web or strip of such labels to bottles. This equipment is provided with an adhesive applicator to apply an adhesive substance to the label, after the label has been severed from the web or strip and before the label is applied to the bottle, to ensure adhesion of the label to the bottle. The adhesive usually used in bottle labeling equipment of this type is a hot-melt adhesive, and the use of such a hot-melt adhesive is messy and can be expensive because of the cost of the adhesive and the cost of equipment for storing it, handling it, and applying it. Further, the use of a hot-melt adhesive system leads to a high temperature environment near the labeling machine which is uncomfortable for the operator and which requires special safety precautions for the proper operation and servicing of the machine. U.S. Pat. No. 4,406,721 (Hoffman) also discloses a system for applying double-ended labels from a web of such labels to bottles or other containers. The system of Hoffman utilizes heat to cause the labels to shrink after they have been applied to the bottles. United States Patent 3,235,433 (Cvacho, et al.) describes a similar system in which a heat-activatable adhesive that is pre-applied to the label is heat activated before the label is applied to the container.

U.S. Pat. No. 4,574,020 (Fosnaught), which is assigned to the assignee of this application, the disclosure of which is hereby incorporated by reference herein, recognized the objection to the use of a hot-melt adhesive in a container labeling system, especially in regard to a container labeling system that utilizes labels formed from thermoplastic materials. The invention described in the aforesaid U.S. Pat. No. 4,574,020 eliminated the need for an applicator to apply a hot-melt adhesive to the label being applied to the bottle by utilizing a gravure roll applicator to apply an unheated solvent to the label to permit the label to adhere to the bottle, the solvent being a solvent at least for the thermoplastic material in the label, for example, methylene chloride as a solvent for labels formed from polystyrene, thereby eliminating some of the disadvantages inherent in utilizing a hot-melt adhesive in a bottle labeling system.

In the operation of the system disclosed in the aforesaid U.S. Pat. No. 4,574,020, one of the most critical aspects is the precise transfer of the solvent from the gravure roll to the surface of the label. If the gravure roll surface and the label surface do not make proper contact, there will not be sufficient solvent applied to the leading edge of the label in order to dissolve the desired portions of the label so as to make it adhere to the bottle or container as it comes into contact therewith and transfers thereto. Likewise, as the label trailing edge overlaps the leading edge, it is absolutely necessary that a full height strip of solvent be applied to the trailing edge so that a complete overlap seam will be formed. This seam must be complete since some subsequent heat shrinkage of the label about the bottle will open the seam up and produce a defective or distorted label if the seam is not sealed throughout its full height.

The label is carried by a rotatable vacuum drum which has sets of raised areas or pads on its periphery that underlie the leading and trailing edges of the label, and the rotating gravure roll is set to engage these raised critical portions of the label during the rotation of the vacuum drum and the gravure roll relative to one another. The gravure roll is normally mounted on a platform which is shiftable about a vertical axis that is parallel to the axis of the roll. In order to ensure that the solvent is properly applied, the gravure roll must carry a sufficient quantity of solvent on its surface pattern. The use of a vertical fountain biased against the gravure to apply solvent to the gravure roll is shown in the aforesaid U.S. Pat. No. 4,574,020. However, the fountain disclosed in this patent requires considerable down time in order to remove the fountain, and it frequently is necessary to remove a fountain to repair a jam up in the labeling machine or to change fountains as they become worn or become contaminated with extraneous materials.

SUMMARY OF THE INVENTION

According to the present invention there is provided a method and apparatus for successively applying flexible thermoplastic labels to the cylindrical body portions of round containers, such as bottles or cans. The apparatus of this invention, which is otherwise generally similar to that disclosed in the aforesaid U.S. Pat. No. 4,574,020 of Harold R. Fosnaught, incorporates a fountain to apply a solvent to a cylindrical gravure roll, and the fountain is contained in a holder which can be quickly and easily swiveled or swung from is operative position to a servicing position where the fountain can be changed or adjusted or otherwise serviced. The fountain holder is positioned at the operative position by a hand releasable latch mechanism.

Accordingly, it is an object of the present invention to provide an improved apparatus for quickly and efficiently sequentially applying plastic labels to containers without using a hot-melt adhesive.

More particularly, it is an object of the present invention to provide an improved fountain apparatus for applying a solvent adhesive to a gravure roll for applying the solvent to preselected portions of a thermoplastic label for a container, which fountain apparatus may be quickly and easily swiveled from an operative position in which a fountain element of the fountain apparatus is in operating contact with the gravure roll to a servicing position where the fountain element can be changed, adjusted or otherwise serviced.

DETAILED DESCRIPTION OF THE PREFERRED EMBODIMENT

Figure 1:
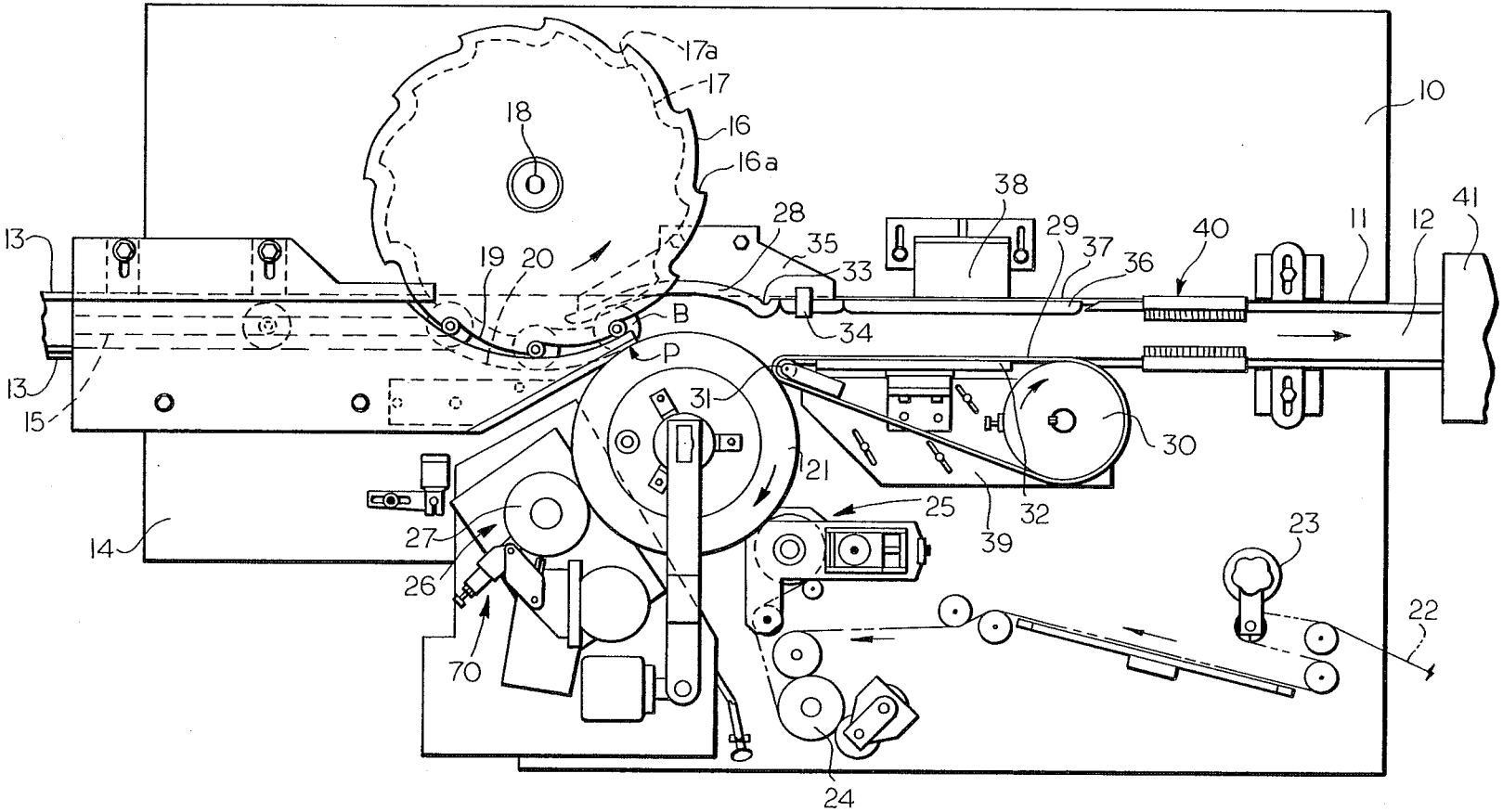
FIG. 1 is a fragmentary plan view showing the apparatus according to the present invention.
Figure 2:
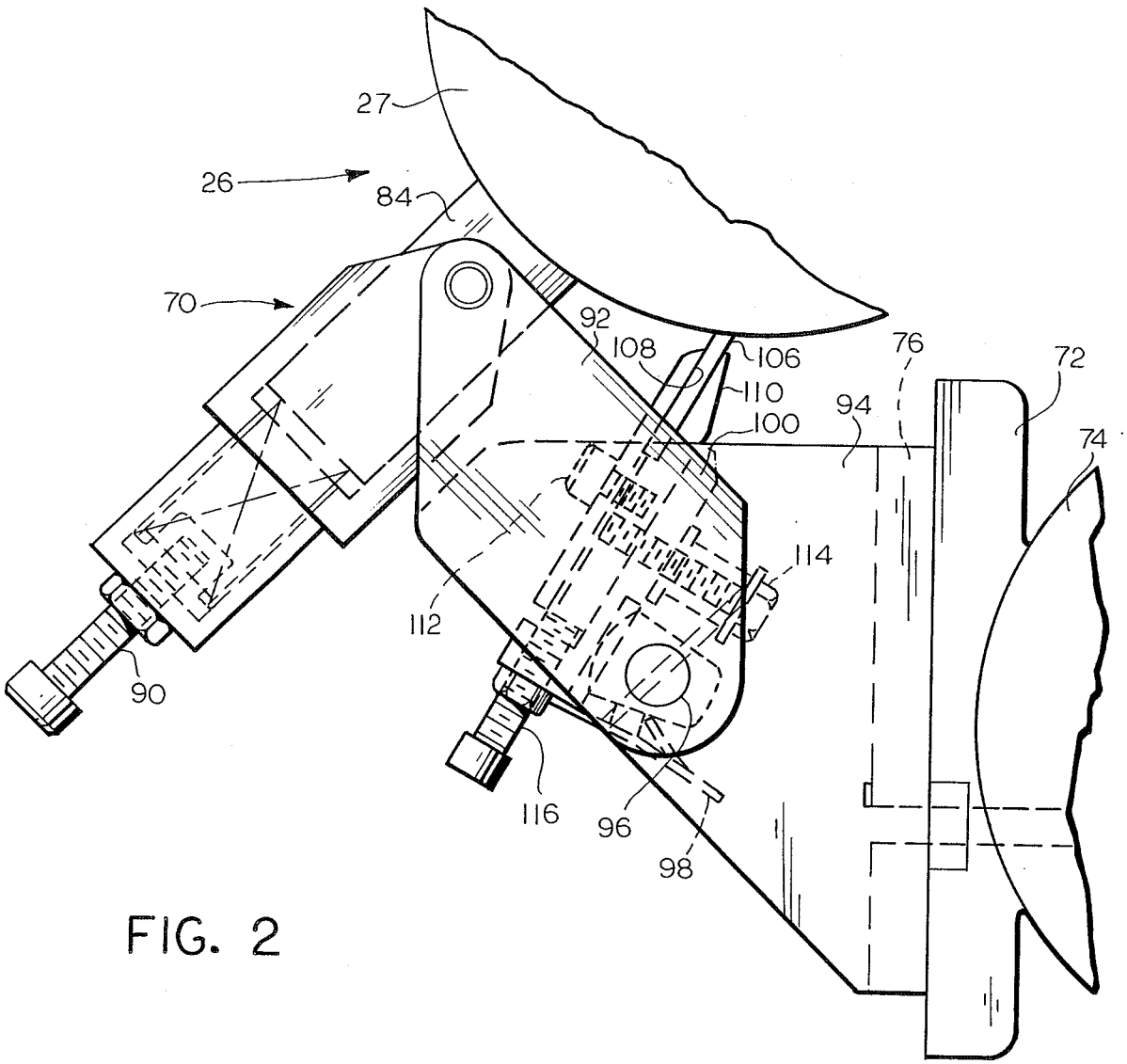
FIG. 2 is a fragmentary plan view showing a portion of the apparatus of FIG. 1, at an enlarged scale relative to FIG. 1.
Figure 3:
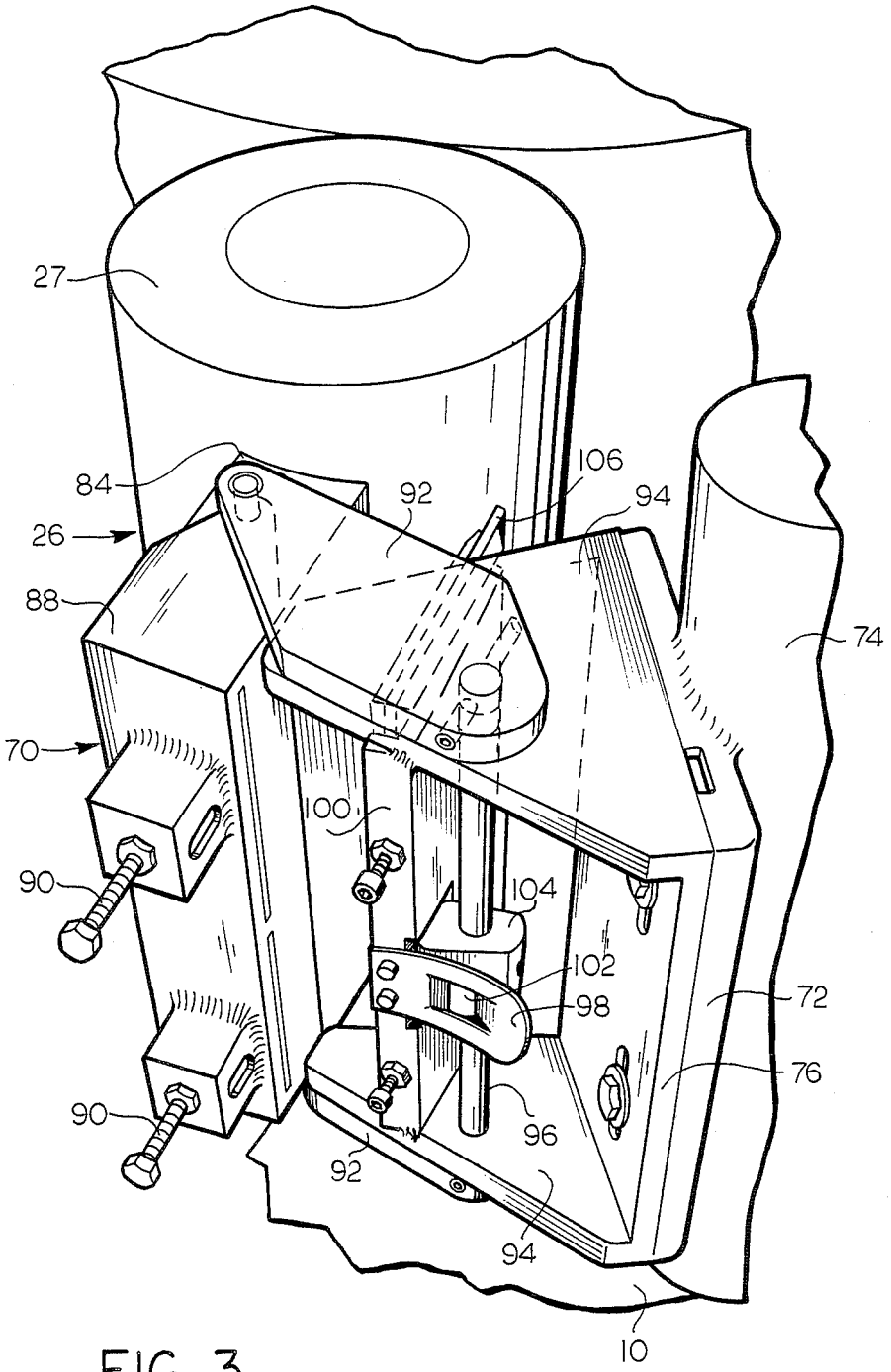
FIG. 3 is a fragmentary perspective view, showing a portion of the apparatus of FIG. 1 and 2.

With particular reference to FIG. 1, the following is a general description of the operation of the overall labeling system. A horizontal supporting table 10 of generally rectangular configuration serves to support the mechanisms and is itself supported above the floor by a plurality of vertical legs (not shown). Mounted above the table and extending generally across the length the table is a conveyor generally designated 11. The conveyor 11 has a horizontally moving upper surface 12 which is driven in the direction of the arrow shown thereon. Containers or bottles B to be labeled are supplied at the left hand end of the conveyor 11 in an upright attitude on the upper surface 12 of the conveyor 11. With the surface 12 moving in the direction of the arrow thereon, the bottles B will be carried from the left to the right as viewed in FIG. 1. The bottles B are guided by rails 13 which extend along either side of the conveyor 11. An overhead member 14 is shown which is provided in its under surface with a guiding slot 15 within which the finish or neck of the bottles will be guided. As can be seen when viewing FIG. 1, the bottles B moving from the left approach a pair of vertically spaced, pocketed starwheels 16 and 17 which are both mounted to a vertical axle 18 which is rotated in a counterclockwise direction as viewed in FIG. 1. The starwheel 16 has twelve pockets **16*a* circumferentially spaced about its circumference, and each of the pockets 16*a* is adapted to engage the neck of a bottle B being handled. Likewise, the starwheel 17 is provided with a like number of pockets 17*a*** that are of somewhat larger dimension and each is adapted to engage the sidewall of a bottle being handled.

An arcuate guide 19 has a contour which is coaxial with respect to the axle 18 and serves to hold the necks of the bottles at a precise distance from the axle 18 of the starwheel 16. In addition, there is a lower arcuate guide 20 which is mounted at a height generally the same as the height of the sidewall or body engaging starwheel 17 to maintain the bottles B with their axes vertical during the movement of the bottles by the starwheels 16 and 17.

When a bottle reaches the position generally designated P, the side of the bottle B at such position will approach, generally tangentially, the circumferential periphery of a vacuum drum 21. The vacuum drum 21 is a generally cylindrical member having a height somewhat greater than the height of a label which is to be applied to one of the bottles B. The drum 21 will have a plurality of vacuum passages opening through the surface thereof to, in effect, grip the individual labels supplied thereto and to convey the labels to the position P. The labels may be formed from a web 22 of foam-film polystyrene which may be pre-printed and which will be coming from a supply (not shown) at the right through a tension takeup device 23. After passing the tension compensation device 23 the web 22 will pass around a driven feed roller 24 and then to a label cutting and handling system generally designated 25. The label cutting device 25 cuts a label from the web 22 at a predetermined point in the length of the web 22 with the leading edge of the label being brought into peripheral engagement with the drum 21. The label will adhere to the outer surface of the drum 21 and move in the direction of the arrow on the drum 21 to carry the label past a solvent applying station 26 where a fountain assembly 70 transfers a solvent to a solvent transfer gravure roll 27 which, in turn, applies the solvent to selected, defined areas of the label. The gravure roll 27 is driven by intermeshing gears generally in a counterclockwise direction, as viewed in FIG. 1, and is timed to present the solvent to the leading and trailing edges of the label which is transported by the vacuum drum 21.

At the point P the leading edge of the label will engage the sidewall of the bottle B and the leading edge of the label will become adhered to the bottle. From this point on, the bottle will be held against the surface of the drum by a primary backup pad 28 which is mounted to the surface of the table 10 by a bracket 35. The backup pad 28 may be formed of a resilient foam material such as foam rubber so that it will effectively hold the bottle B against the surface of the drum, and as the drum continues to rotate the bottle will be effectively rolled along the surface of the label carried on the surface of the vacuum drum 21.

As previously described, the label carried by the drum 21 will have a vertical, full height line of solvent applied to the trailing edge thereof and the trailing edge of the label will overlap the leading edge and adhere thereto to form an overlap seam. The container with the label applied continues to be guided by the primary backup pad 28 until it reaches a secondary roll-on belt 29. The secondary roll-on belt 29 passes about a drive roll 30 which is driven in the direction of the arrow thereon. The belt 29 also passes about a relatively small diameter inlet roll 31. A stationary, vertical backup surface 32 maintains the belt 29 in a fairly straight path between the drive roll 30 and the inlet roll 31. The bottle B will have the label completely wrapped thereabout prior to the movement of the bottle into engagement with the secondary roll-on belt 29. The primary backup pad 28 has an area 33 which tends to maintain the bottle in contact with the vacuum drum 21 until such time as the bottle engages the secondary roll-on belt 29. This provides a positive drive for the bottle so that when the bottle passes to the secondary roll-on belt, it will be rotated while moved along by the moving surface of the belt 29. The moving belt drives the rolling bottle so that the overlap seam of the label will contact a resilient pressing pad 34 which is mounted beyond the primary pad 28 on the bracket 35.

A secondary backup pad 36 is positioned in a bottle engaging, diametrically opposed position relative to the secondary roll-on belt 29. The secondary backup pad 36 is also formed with a foam rubber or like resilient member mounted to a plate 37 which in turn is mounted by bracket 38 to the top of the table 10. The secondary roll-on belt 29 and its drive roll 30 and the inlet roll 31 are both mounted on a mounting plate 39 which may be moved relative to the upper surface of the table 10, and thus be adjusted toward or away from the center lime of the conveyor 12 to accommodate the mechanism for different sizes of bottles. Likewise, the secondary backup pad 36 and the bracket 38 which supports it may be moved toward or way form the center line of the conveyor 12.

As can be seen when viewing FIG. 1, the bottles B, after passing between the secondary backup pad 36 and the secondary roll-on belt 29, will be held back by a brush spacer, generally designated 40, and the bottles B are moved through the brush spacer 40 in surface-to-surface contact under the force created by the moving belt 29, until such time as the leading bottle clears the spacer 40, at which time the bottle is free to move at the speed of the conveyor 12 into a heat shrink oven 41. The bottles B will leave the brush spacer 40 at regular intervals depending upon the speed with which the label wrap machine is operating. It should be understood that the drum 21 and drive roll 30 are commonly driven.

The fountain assembly 70 of the present invention is mounted on a vertically extending plate 72 which, in turn, is attached to a support pedestal 74 that is attached to the supporting table 10, and the fountain assembly 70 includes a support plate 76 which is detachably mounted in face to face relationship with the plate 72. The fountain assembly 70 further includes a hard plastic fountain block 84 which has a part-cylindrical contoured face 86 that bears against the gravure roll 27 to properly apply solvent thereto, solvent being applied to internal passages (not shown) within the fountain block 84 by suitable fluid connection lines (also not shown). For optimum contact between the fountain block 84 and the gravure roll 27, the fountain block 84 is adjustably mounted within a fountain block holder 88 that is an element of the fountain assembly 70, and spaced, threaded fountain block adjustment devices 90 are provided to adjust the position of the fountain block 84 within the fountain block holder 88. The fountain block holder 88 is pivotally attached to spaced apart flanges 92 about a vertically extending axis that is positioned between the edges of the fountain block 84. Thus, the fountain block 84 in the fountain block holder 88 has some freedom to pivot with respect to the gravure roll 27 for optimum contact therewith. The spaced apart flanges 92, in turn, are attached to a pivot rod 96 which is pivotally attached to spaced apart flanges 94 which are fixedly attached to the support plate 76. The pivot rod 96 is positioned away from the axis of the attachment of the fountain block holder 88 to the spaced apart flanges 92. Thus, the pivoting of the spaced apart flanges 92 which respect to the spaced apart flanges 94 permits the swiveling of the fountain block holder 88 and the fountain block 84 away from the gravure roll 27 to permit the changing, adjustment or servicing of the fountain block 84. The pivoting of the spaced apart flanges 92 with respect to the spaced apart flanges 94 is selectively limited by a releasable latch device in the form of a generally planar, apertured spring steel plate 98 which is attached at one of its ends to a vertical plate 100 that is fixedly attached to each of the spaced apart plates 94. The apertured spring steel plate 98 normally receives a vertical stop surface 102 of a boss 104 that is fixedly attached to the pivot rod 96 to prevent the pivoting of the spaced apart flange 92 with respect to the spaced apart flanges 94 from the operating position in which the fountain block 84 is adapted to apply solvent to the gravure roll 27. However, by the manual deflection of the free end of the steel plate 98, it will no longer engage the stop surface 102 of the boss 104, whereupon the spaced apart flanges 92, including the fountain block holder 88 and the fountain block 84 can be pivoted with respect to the spaced apart flanges 94 about an axis extending through the pivot rod 96 to present the fountain block 84 at an accessible location for changing, adjustment or servicing.

For optimum operation, the fountain assembly 70 is also provided with a doctor blade 106 to remove any excess solvent that may be transferred to the gravure roll from the fountain block 84. The doctor blade 106 is made out of a hard plastic material and is retained in a slot 108 of a blade holder 110 that is attached to the plate 100 by threaded fasteners 112 which extend from one side of the plate 100 and by spring mounted threaded fasteners 114 which extend from the other side of the plate 114 to provide the doctor blade 106 with some resiliency in its mounting. Further, the position of the doctor blade 106 within the slot 108 is adjustable by means of threaded adjustment devices 116 which engage the rear edge of the doctor blade 106 to adjustably position its leading edge relative to the gravure roll 27.

Although the best mode contemplated by the inventor for carrying out the present invention as of the filing date hereof has been shown and described herein, it will be apparent to those skilled in the art that suitable modifications, variations, and equivalent may be made without departing from the scope of the invention, such scope being limited solely by the terms of the following claims.

What is claimed is:

1. Apparatus for sequentially wrapping flexible thermoplastic labels around containers, each of said containers having one of each of said flexible thermoplastic labels wrapped therearound by said apparatus, each of said containers having a generally cylindrical body portion, each of said flexible thermoplastic labels being wrapped around the cylindrical body portion of one of said containers by said apparatus, said apparatus comprising:

a rotatable vacuum drum;

means for rotating said rotatable vacuum drum;

means for sequentially providing said labels to said rotatable vacuum drum to successively apply a leading edge of each of said labels against said rotating vacuum drum to be temporarily retained against said rotatable vacuum drum;

rotatable gravure roll means forming a nip with said rotatable vacuum drum for applying a solvent to predetermined portions of each of said flexible thermoplastic labels as said each of said flexible thermoplastic labels passes through said nip, said solvent forming an adhesive with said predetermined portions of said each of said flexible thermoplastic labels;

fountain assembly means for applying a solvent to said rotatable gravure roll means;

means for sequentially transferring said labels from said rotatable vacuum drum to said body portions of said containers at a wrapping station to effect sequential adhesion of said labels to said body portions of said containers; and means for mounting said fountain assembly means, said means for mounting including:

first support plate means, said fountain assembly means being pivotally attached to said first support plate means about a first axis;

second support plate means said first support plate means being pivotally attached to said second support plate means about a second axis, said second axis being spaced from said first axis and extending generally parallel thereto; and releasable latch means for releasably preventing said first support plate means from pivoting with respect to said second support plate means to maintain said fountain assembly means in an unreleased position to apply the solvent to said rotatable gravure roll means, and upon the release of said releasable latch means to permit said first support plate means with said fountain assembly means to be pivoted away from said rotatable gravure roll means to permit servicing of said fountain assembly means.

2. Apparatus according to claim 1 wherein said fountain assembly means further comprises:

a solvent applying fountain operatively attached to said first support plate means, said solvent applying fountain including a fountain block with a part cylindrical face that is maintained in solvent applying, surface to surface engagement with said rotatable gravure roll means when said releasable latch means is in the unreleased position.

3. Apparatus according to claim 2 wherein said fountain assembly means further comprises:

a fountain block holder, a part of said fountain block that is away from said part cylindrical face being received in said fountain block holder; and spaced fountain block adjustment devices for adjusting the position of said fountain block within said fountain block holder.

4. Apparatus according to claim 3 wherein said rotatable gravure roll means has an axis of rotation, and wherein said axis of rotation is parallel to said first axis and said secon axis.

5. Apparatus according to claim 4 wherein each of said axis of rotation, said first axis and said second axis extends vertically.

6. Apparatus according to claim 1 wherein said first support plate means comprises a first pair of spaced apart plates and a pivot rod which extends between each of said first pair of spaced apart plates, wherein said second support plate means comprises a second pair of spaced apart plates, said pivot rod pivotally extending through each of said second pair of spaced apart plates, and wherein said releasable latch means comprises a boss which is fixedly attached to said pivot rod, said boss having a stop surface, said releasable latch means further comprising generally planar spring means attached to said second support plate means, said spring means having an aperture therein which is adapted to releasably engage said stop surface of said boss.

7. Apparatus according to claim 6 wherein said second support plate means further comprises plate means extending between each of said second pair of spaced apart plates, and wherein said spring means has a first end which is attached to said plate means and a second end which is free and which is manually deflectable to release said releasable latch means.

8. Apparatus according to claim 7 wherein said apparatus further comprises:

doctor blade means extending between each of said second pair of spaced apart plates for removing excess solvent from said rotatable gravure roll means.

* * * * *